United States Patent [19]

Counts et al.

[11] Patent Number: 5,060,671

[45] Date of Patent: Oct. 29, 1991

[54] FLAVOR GENERATING ARTICLE

[75] Inventors: Mary E. Counts; Bernard C. LaRoy; D. Bruce Losee, Jr., all of Richmond; Constance H. Morgan; Ulysses Smith, both of Midlothian; F. Murphy Sprinkel, Jr., Glen Allen; Francis V. Utsch, Midlothian, all of Va.

[73] Assignee: Philip Morris Incorporated, New York, N.Y.

[21] Appl. No.: 444,746

[22] Filed: Dec. 1, 1989

[51] Int. Cl.[5] ..... A24K 47/00

[52] U.S. Cl. ..... 131/329; 131/273; 128/202.21; 128/203.17; 128/203.27

[58] Field of Search ..... 131/270, 273, 194–197, 131/359, 369; 128/202, 202.21, 203.17, 203.27

[56] References Cited

U.S. PATENT DOCUMENTS

| | | | |
|---|---|---|---|
| 1,771,366 | 7/1930 | Wyss et al. . | |
| 1,968,509 | 7/1934 | Tiffany . | |
| 2,057,353 | 10/1936 | Whittemore, Jr. . | |
| 2,104,266 | 1/1938 | McCornick | 131/273 |
| 2,442,004 | 5/1948 | Hayward-Butt . | |
| 2,974,669 | 3/1961 | Ellis . | |
| 3,280,819 | 8/1965 | Gilbert . | |
| 3,363,633 | 1/1968 | Weber . | |
| 3,402,723 | 9/1968 | Hu . | |
| 3,482,580 | 12/1969 | Hollabaugh . | |
| 3,804,100 | 4/1974 | Fariello . | |
| 3,889,690 | 6/1975 | Guarnieri . | |
| 4,016,061 | 4/1977 | Wasa et al. . | |
| 4,068,672 | 1/1978 | Guerra . | |
| 4,077,784 | 3/1978 | Vayrynen . | |
| 4,131,119 | 12/1978 | Blasutti . | |
| 4,141,369 | 2/1979 | Burruss . | |
| 4,164,230 | 8/1979 | Pearlman . | |
| 4,193,411 | 3/1980 | Faris et al. . | |
| 4,215,708 | 8/1980 | Bron . | |
| 4,219,032 | 8/1980 | Tabatznik et al. . | |
| 4,246,913 | 1/1981 | Ogden et al. . | |
| 4,256,945 | 3/1981 | Carter et al. . | |
| 4,259,970 | 4/1981 | Green, Jr. . | |
| 4,303,083 | 12/1981 | Burruss, Jr. . | |
| 4,393,884 | 7/1983 | Jacobs . | |
| 4,431,903 | 2/1984 | Riccio . | |
| 4,436,100 | 3/1984 | Green, Jr. . | |
| 4,463,247 | 7/1984 | Lawrence et al. . | |
| 4,562,337 | 12/1985 | Lawrence . | |
| 4,570,646 | 2/1986 | Herron . | |
| 4,580,583 | 4/1986 | Green, Jr. . | |
| 4,621,649 | 11/1986 | Osterrath . | |
| 4,623,401 | 11/1986 | Derbyshire et al. . | |
| 4,637,407 | 1/1987 | Bonanno et al. . | |
| 4,659,912 | 4/1987 | Derbyshire . | |
| 4,735,217 | 4/1988 | Gerth et al. | 131/273 |
| 4,771,796 | 9/1988 | Myer . | |
| 4,776,353 | 10/1988 | Lilja et al. . | |
| 4,837,421 | 6/1989 | Luthy . | |
| 4,846,199 | 7/1989 | Rose . | |
| 4,848,376 | 7/1989 | Lilja et al. . | |
| 4,874,924 | 10/1989 | Yamamoto et al. . | |
| 4,877,989 | 10/1989 | Drews et al. . | |
| 4,922,901 | 5/1990 | Brooks et al. . | |
| 4,945,931 | 8/1990 | Gori . | |
| 4,947,874 | 8/1990 | Brooks et al. . | |
| 4,947,875 | 8/1990 | Brooks et al. . | |

FOREIGN PATENT DOCUMENTS

| | | |
|---|---|---|
| 1202378 | 3/1986 | Canada . |
| 87/104459 | 2/1988 | China . |
| 0295122 | 12/1988 | European Pat. Off. . |
| 0358002 | 3/1990 | European Pat. Off. . |
| 0358114 | 3/1990 | European Pat. Off. . |
| 3640917A1 | 8/1988 | Fed. Rep. of Germany . |
| 3735704A1 | 5/1989 | Fed. Rep. of Germany . |
| 61-68061 | 4/1986 | Japan . |
| WO86/02528 | 4/1986 | PCT Int'l Appl. . |
| 2132539 | 7/1984 | United Kingdom . |
| 2148079 | 5/1985 | United Kingdom . |
| 2148676 | 5/1985 | United Kingdom . |

OTHER PUBLICATIONS

"Excerpt from 'NASA Tech Briefs'," Jul./Aug. 1988, p. 31.

"PTC Thermistors," Keystone Carbon Company product literature.

*Primary Examiner*—V. Millin

*Attorney, Agent, or Firm*—Jeffrey H. Ingerman

[57] ABSTRACT

An article is provided in which a flavor generating medium is electrically heated to evolve inhalable flavors or other components in vapor or aerosol form. The article has a plurality of charges of the flavor generating medium which are heated sequentially to provide individual puffs.

84 Claims, 10 Drawing Sheets

FIG. 7A
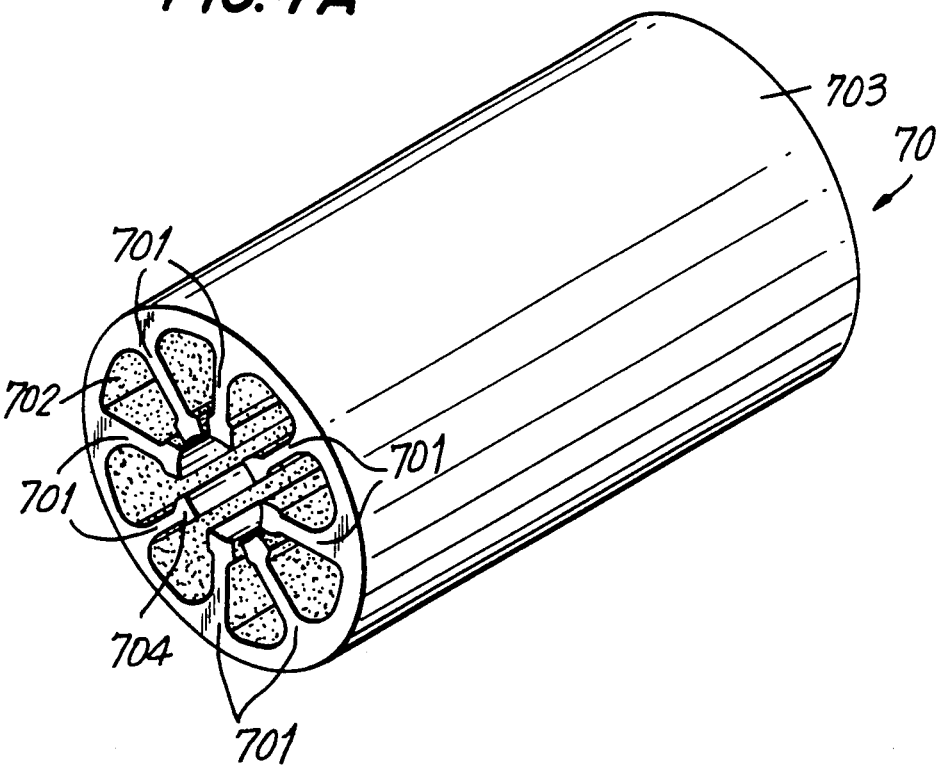
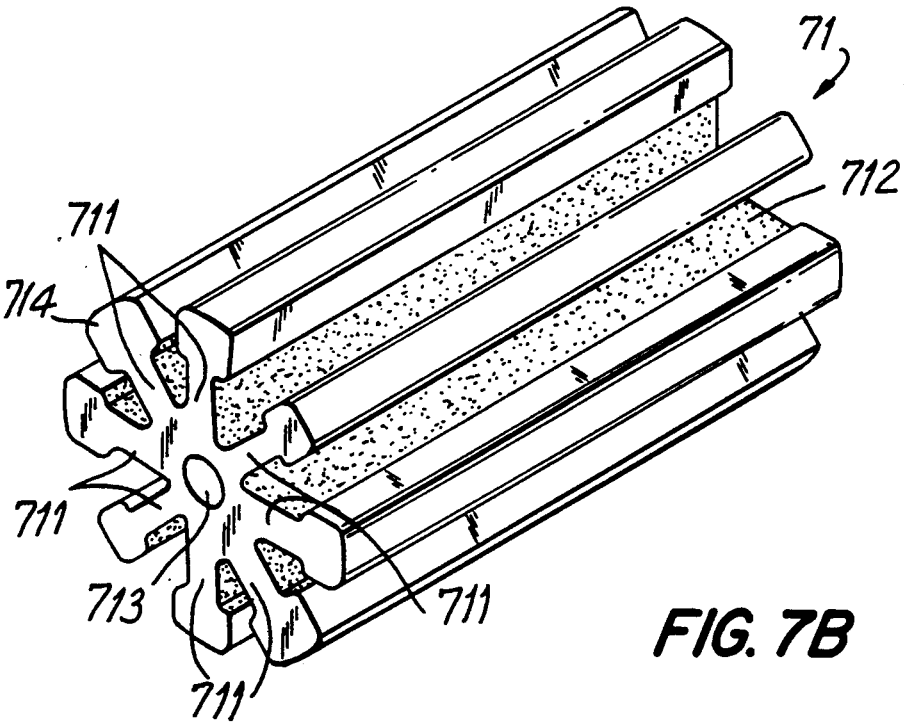
FIG. 7B

FIG. 7C
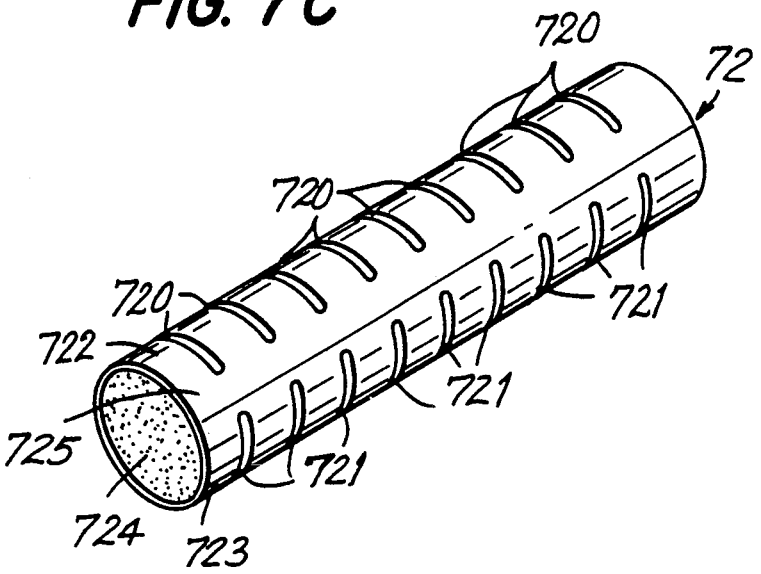
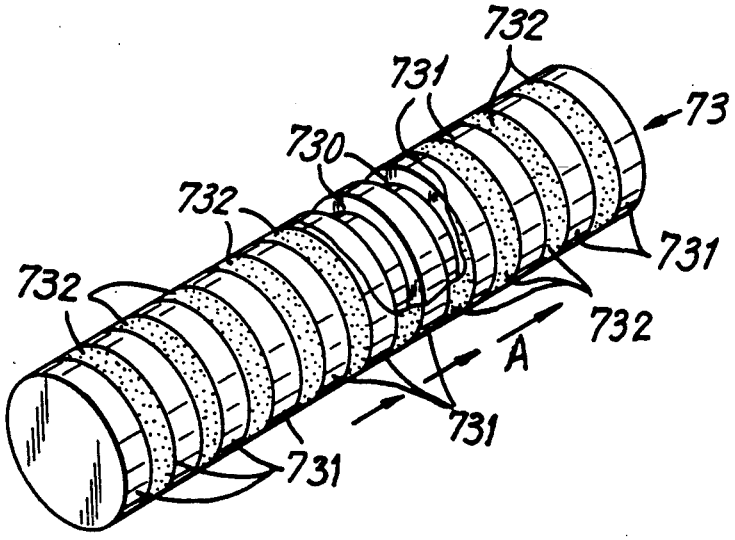
FIG. 7D

FIG. 7H
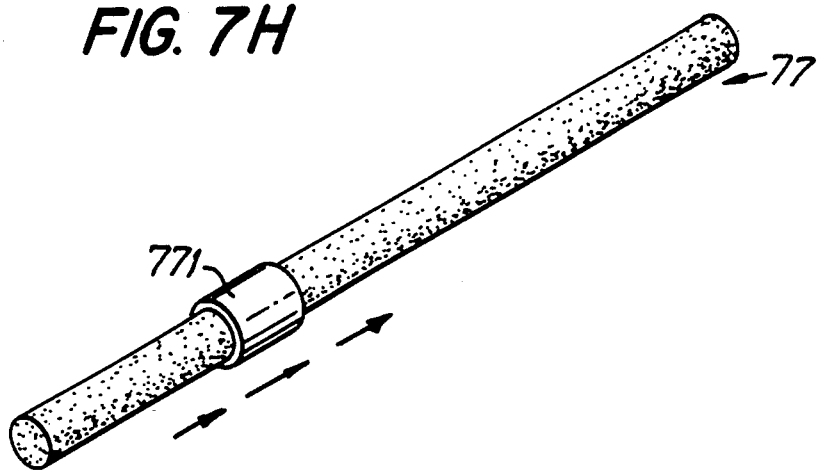
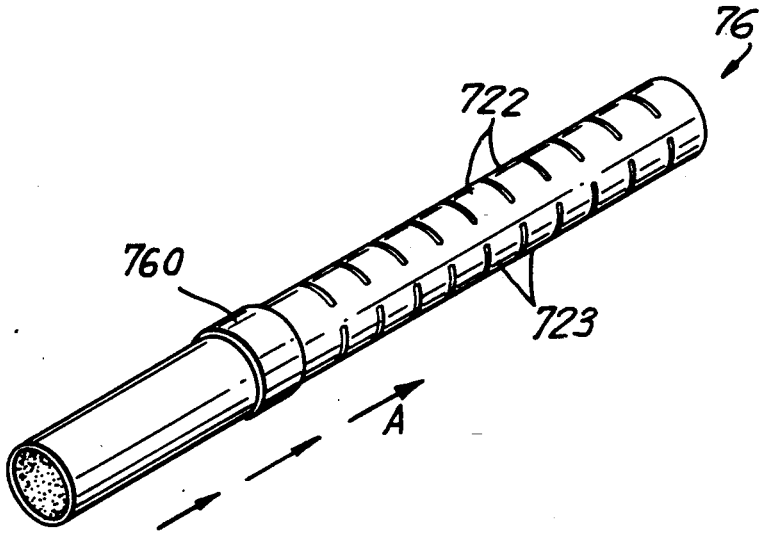
FIG. 7G.

FLAVOR GENERATING ARTICLE

BACKGROUND OF THE INVENTION

This invention relates to articles in which flavor generating media are heated but not burned to release tobacco flavors. More particularly, this invention relates to electrically heated articles.

It is known to provide smoking articles in which a flavor bed of tobacco or tobacco-derived material is heated, without combustion of tobacco, to release tobacco flavors without producing all the normal products of tobacco combustion. For example, it is known to provide a smoking article having a bed of tobacco-derived material and a combustible heat source. A smoker draws air through or around the heat source, heating it, and the heated air passes through the flavor bed, releasing tobacco flavors that are drawn into the smoker's mouth. The heat source temperature, is dependent on how the smoker uses the article, so that the flavor release rate varies widely from user to user and from article to article for a particular user.

Articles that produce the taste and sensation of smoking by heating tobacco electrically are also known. However, in some known electrically heated articles the temperature was not consistent because the output of the electrical power source was not well regulated, so that the release of flavors also was not consistent. In other known electrically heated articles the power source was external to the article and inconvenient.

It would be desirable to be able to provide an electrically heated article which operates at a controlled temperature to produce a predetermined release of flavor with each puff.

It would also be desirable to be able to provide such an article which consistently for each puff reaches its operating temperature quickly and remains at that temperature long enough to release the desired flavors, without overheating and causing burning of its flavor source, while at the same time minimizing the consumption of energy.

It would further be desirable to be able to provide such an article which is self-contained.

It would still further be desirable to be able to provide such an article which can have the appearance of a conventional cigarette, but produces neither sidestream smoke nor ash, and is not hot between puffs.

SUMMARY OF THE INVENTION

It is an object of this invention to provide an electrically heated article which operates at a controlled temperature to produce a consistent release of flavor with each puff.

It is also an object of this invention to provide such an article which consistently for each puff reaches its operating temperature quickly and remains at that temperature long enough to release the desired flavors, without overheating and causing burning of its flavor source, while at the same time minimizing the consumption of energy.

It is a further object of this invention to provide such an article which is self-contained.

It is still a further object of this invention to provide such an article which can have the appearance of a conventional cigarette, but produces neither sidestream smoke nor ash, and is not hot between puffs.

In accordance with this invention, there is provided an article for delivering to a consumer a flavor-containing substance. The article comprises a plurality of charges of flavor generating medium, electrical heating means for individually heating each of the plurality of charges, a source of electrical energy for powering the electrical heating means, and control means for applying the electrical energy to the electrical heating means to individually heat one of the plurality of charges. Each of the charges, when heated, delivers a quantity of flavor-containing substance to the consumer.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIGS. 7A–7K are perspective views of various embodiments of heaters for use in the present invention;

DETAILED DESCRIPTION OF THE INVENTION

Figure 1:
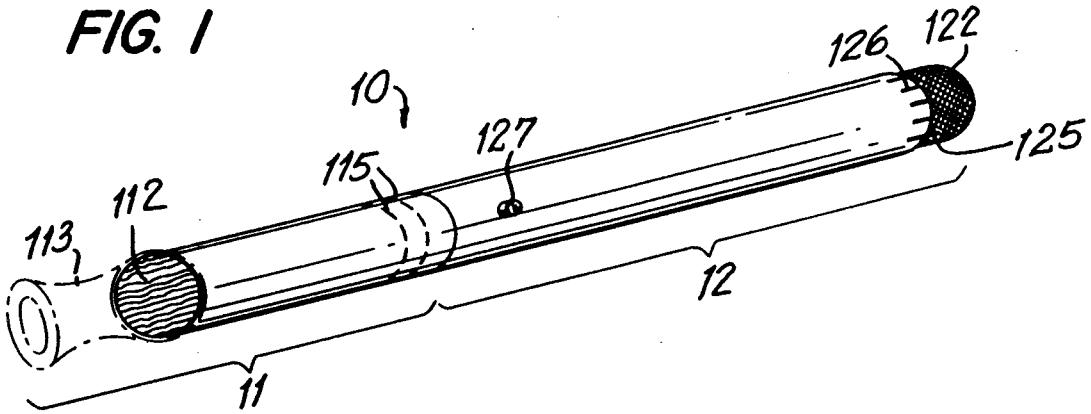
FIG. 1 is a perspective view of a first embodiment of an article according to the present invention.

The basic article of the present invention includes a source of electrical energy, an electrical heater or heaters, electrical or electronic controls for delivering electrical energy from the source of electrical energy to the heaters in a controlled manner, and a flavor generating medium in contact with the heater. When the heater heats the flavor generating medium, flavor-containing substance—i.e., a vapor or aerosol, or mixture thereof, containing flavored vapors or aerosols or other vapor or aerosol components—is generated or released and can be drawn in by the consumer. (In the discussion that follows, either of the words "generate" or "release", when used alone, includes the other, and the word "form", when used in connection with the phrase "flavor-containing substance," means "generate or release.")

The flavor generating medium can be any material that, when heated, releases a flavor-containing substance. Such materials can include tobacco condensates or fractions thereof (condensed components of the smoke produced by the combustion of tobacco, leaving flavors and, possibly, nicotine), or tobacco extracts or fractions thereof, deposited on an inert substrate. These materials when heated generate or release a flavor-containing substance (which may include nicotine) which can be drawn in by the consumer. The flavor generating medium can also be unburned tobacco or a composition containing unburned tobacco that, when heated to a temperature below its burning temperature, generates or releases a flavor-containing substance. Any of these flavor generating media can also include an aerosol-forming material, such as glycerine or water, so that the consumer has the perception of inhaling and exhaling "smoke" as in a conventional cigarette. A particularly preferred material is a composition such as that described in copending, commonly-assigned U.S. patent application Ser. No. 222,831, filed July 22, 1988, hereby incorporated by reference in its entirety, which describes pelletized tobacco containing glycerine (as an aerosol-forming ingredient) and calcium carbonate (as a filler). As used in the present invention, the composition, instead of being formed into pellets, would be deposited as a coating, in conjunction with adhesion agents such as citrus pectin, on a heater or on an inert substrate in contact with a heater.

The flavor generating medium is divided into individual charges, each representing one puff of the article. It is possible to mimic a conventional cigarette by providing a number of charges of flavor generating medium equal to an average number of puffs per cigarette, e.g., eight to ten puffs. Although the article does not decrease in length like a conventional cigarette as it is operated, it is possible to make the article in varying lengths, with different numbers of puffs. By providing individual charges for each puff, one reduces the total amount of flavor generating medium that must be provided, as compared with a single larger charge that would be electrically heated or reheated once for each of several puffs. The amount of electrical energy needed to heat a number of individual charges is also less than the amount needed to heat an entire large bed several times while also maintaining a controlled lower bed temperature between puffs, as necessary.

The portion of the article according to the present invention that contains the heaters and the flavor generating medium is preferably a replaceable plug-in unit, so that when all of the charges have been heated, the spent plug-in unit can be discarded and a new one inserted. The controls and power source could be retained.

Figure 2:
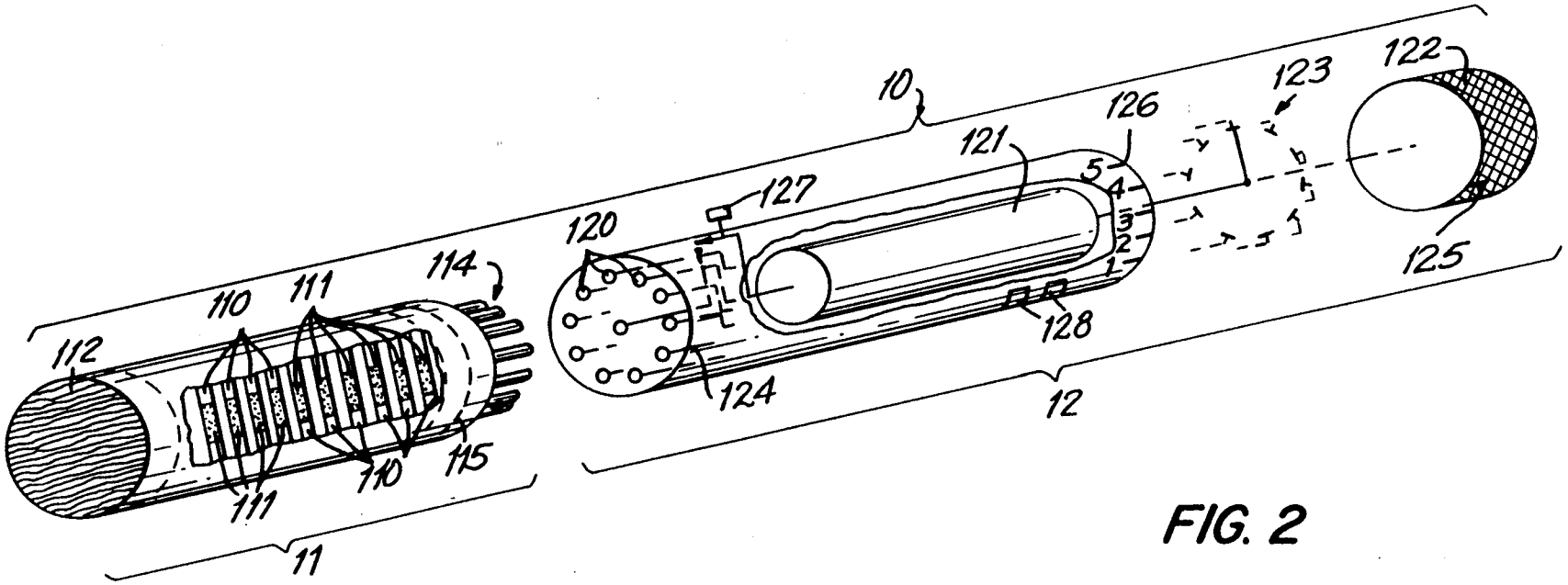
FIG. 2 is a partially fragmentary exploded perspective view of the article of FIG. 1.

One embodiment of article 10 according to the invention is shown in FIGS. 1 and 2. Article 10 is the simplest form of article according to the present invention, and includes heater/flavor/mouthpiece section 11 and power and control section 12. Section 11 includes a plurality of heaters 110, each having deposited on its surface a quantity of flavor generating medium 111. The heater configuration shown in FIG. 2 is illustrative only. Different possible heater configurations will be discussed below. Preferably, there is a segment of filter material 112, such as conventional cellulose acetate or polypropylene cigarette filter material, possibly in conjunction with paper-wrapped tobacco rod sections, at the mouth end of section 11, both for aesthetic purposes as well as to provide appropriate filtration efficiency and resistance-to-draw to the system. In addition, mouthpiece 113 can optionally be included.

As shown in FIG. 2, there are ten heaters 110 in section 11. There are also eleven contact pins 114 extending from section 11 remote from its mouth end—common pin and ten pins connected to individual heaters 110—that fit into eleven sockets 120 on section 12 to make electrical contact between heaters 110 and power source 121, the nature of which will be discussed in more detail below.

A knurled knob 122 is provided at the remote end of section 12 to allow the consumer to select one of the heaters 110. Knob 122 controls a single-pole ten position rotary switch 123 connected by wires 124 to sockets 120. Index mark 125 on knob 122 and graduations 126 on the body of section 12 assist the consumer in selecting the next heater 110. To operate article 10, the consumer selects a heater 110 using knob 122 and presses momentary-on pushbutton switch 127 to complete the circuit and energize the selected heater 110 to initiate heating. Flavor generating medium 111, thus heated, can release or generate a flavor-containing substance. The consumer draws in the flavor-containing substance along with air drawn through perforations 115 in the outer wrapper of section 11 or 12, which could be conventional cigarette paper or tipping paper. Air may also enter through the end of section 12 remote from the mouth end through channels that may be provided for that purpose, carrying the air around power source 121 and around other internal components of section 12. What is important is that the air enter section 11 at a point at which it can fully sweep heaters 110 to carry the maximum amount of flavor-generating substance to the mouth of the consumer.

When all ten charges in section 11 have been heated, section 11 is spent, and can be unplugged from article 10 and a new section 11 can be plugged in. Section 12 as envisioned is reusable.

Figure 3:
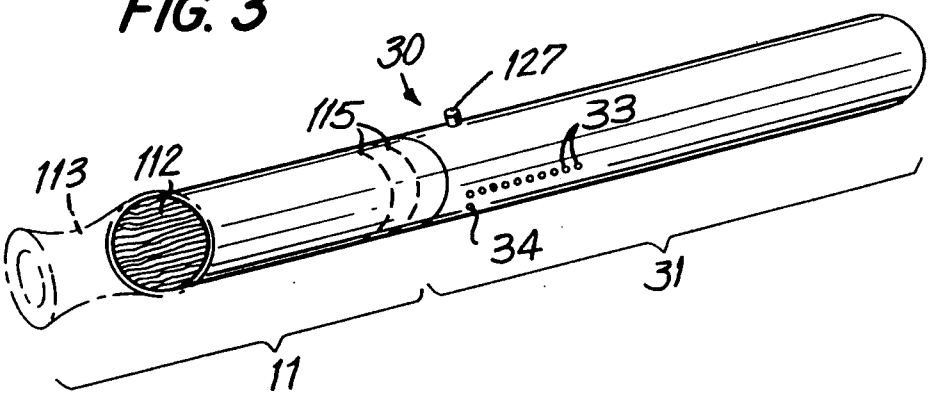
FIG. 3 is a perspective view of a more preferred second embodiment of an article according to the present invention.

In article 10, it is possible that the consumer will select a particular heater 110 more than once, giving rise to the possibility of reheating the flavor generating medium and producing less preferred vapor or aerosol compounds, unless knob 122 is designed so that it can only be rotated in one direction and only for one complete revolution. But in that case, its ability to rotate would have to be restored when section 11 is replaced, which is mechanically complex to achieve. Therefore, a more preferred embodiment 30 of an article according to the present invention, shown in FIGS. 3 and 4, includes controls that automatically select which charge will be heated, as well as the duration of heating.

Article 30 includes a heater/flavor/mouthpiece section 11 identical to section 11 of article 10. However, power and control section 31 contains electronic control circuit 32 (described in more detail below) in place of mechanical switch 123 of power and control section 12 of article 10. Control circuit 32, in response to depression of pushbutton 127, selects one of charges 111 that has not previously been used, and supplies power from power source 121 to the associated heater 110 for a predetermined duration. After all ten charges 111 have been used, circuit 32 no longer supplies power to any heater until spent section 11 is replaced by a fresh unit. Optionally, control circuit 32 also locks out pushbutton 127 for a predetermined lockout period after each depression, so that heaters 110 are not energized too soon one after the other.

Articles according to the present invention do not decrease in length like conventional cigarettes do as they are smoked, because they do not burn. Therefore, in order to provide some indication to a consumer of how much of article 30 has been used or remains to be used, visual indicators 33, which can be a series of ten light emitting diodes or a bar graph or similar indicator, under the control of circuit 32, are preferably provided to display either how many of charges 111 have been used or how many remain. Similarly, there is no glowing coal as in a conventional cigarette to indicate to the consumer that the article is operating. Optionally, an additional light emitting diode 34 or similar indicator, also under the control of circuit 32, can be provided to show when one of heaters 110 is energized. An additional indicator or indicators (not shown) may also be provided to show that the lockout period is in effect or that it is over.

Figure 5:
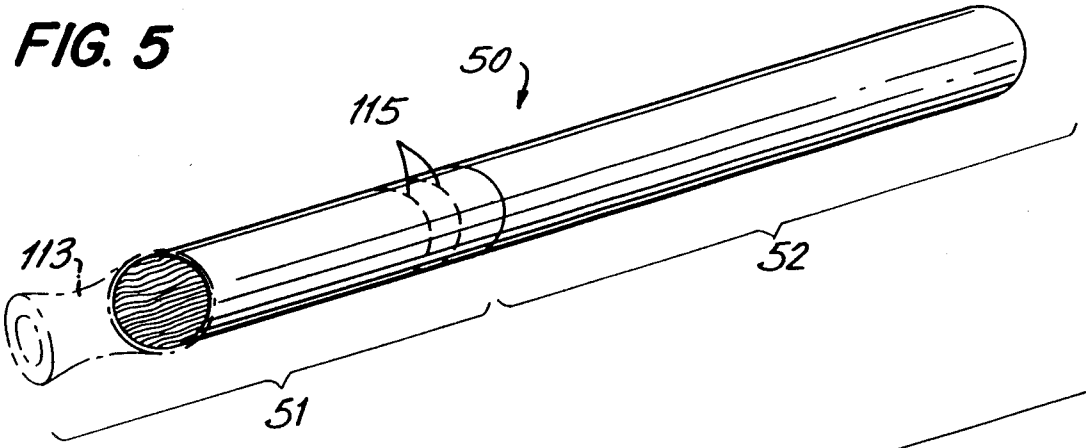
FIG. 5 is a perspective view of a still more preferred article according to the present invention.
Figure 6:
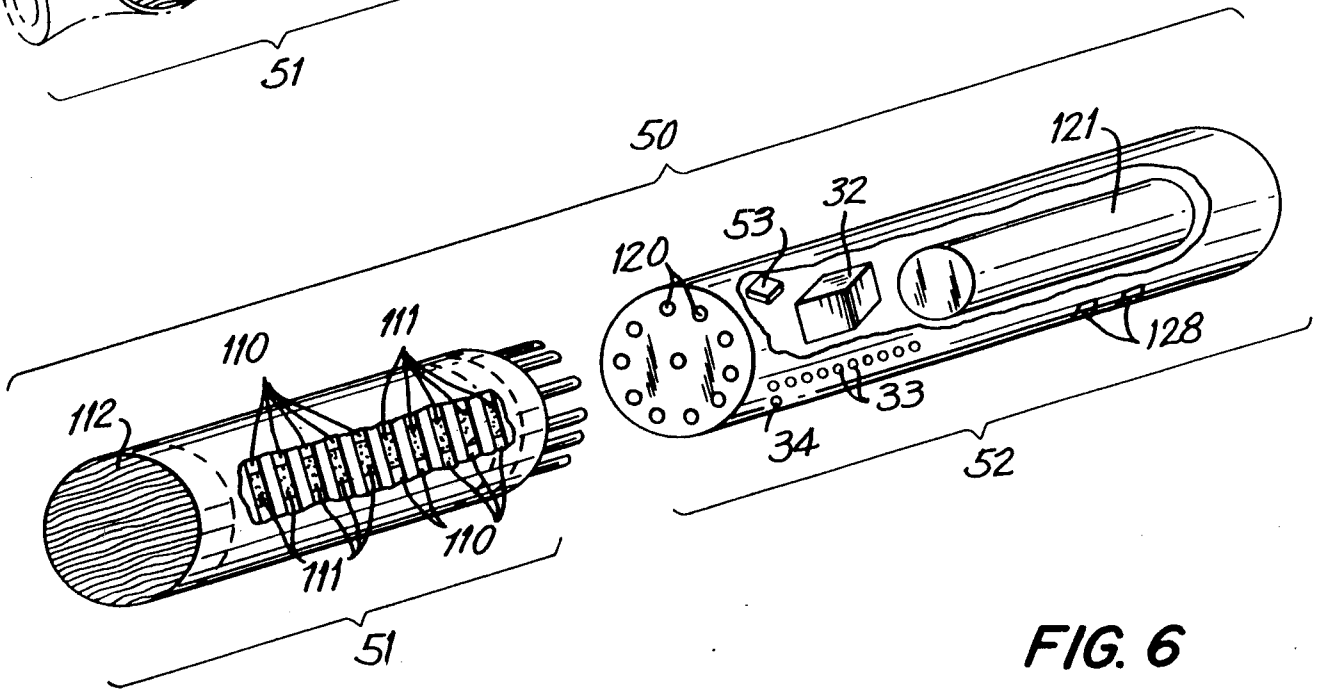
FIG. 6 is an exploded perspective view of the article of FIG. 5.

In the most particularly preferred embodiment, an article according to this invention does not have a pushbutton 127, but is responsive to the consumer's drawing on the article, similarly to a conventional cigarette. Therefore, article 50, shown in FIGS. 5 and 6, is identical to article 30, except that section 52 lacks pushbutton 127. Pushbutton 127 is replaced by a switch 53 in section 52 that is sensitive either to pressure changes or air flow changes as the consumer draws on article 50. It has been found that when a Model 163PC01D36 silicon sensor, manufactured by the MicroSwitch division of Honeywell, Inc., Freeport, Ill., is used in a preferred embodiment of the invention, the appropriate heater is activated sufficiently rapidly by the change in pressure when the consumer draws on article 50. In addition, flow sensing devices, such as those using hot-wire anemometry principles, have been successfully demonstrated to actuate the appropriate heater 110 sufficiently rapidly after sensing a change in air flow.

The heaters 110 used in the present invention would have to heat the flavor generating medium to a temperature in the range of from about 100° C. to about 600° C., and preferably from about 200° C. to about 500° C., and more preferably from about 300° C. to about 400° C., to release the desired flavors from the flavor generating medium. To release or generate the desired flavors from the flavor generating medium, heater 110 should be energized for a duration of from about 0.1 second to about 4 seconds, preferably from about 0.5 second to about 1.5 seconds, and more preferably from about 0.8 second to about 1.2 seconds. The optimum temperature and total heating time depend on the heater mass, the mass of the flavor generating medium 111 on heater 110, the configuration of heater 110 and flavor generating medium 111 thereon, and the thermal/physical properties of heater 110 and flavor generating medium 111. The heating conditions are most preferably chosen to prevent burning of flavor generating medium 111. At the same time, heaters 110 are preferably part of replaceable heater/flavor/mouthpiece section 11, and therefore they need not be capable of more than one use.

Figure 4:
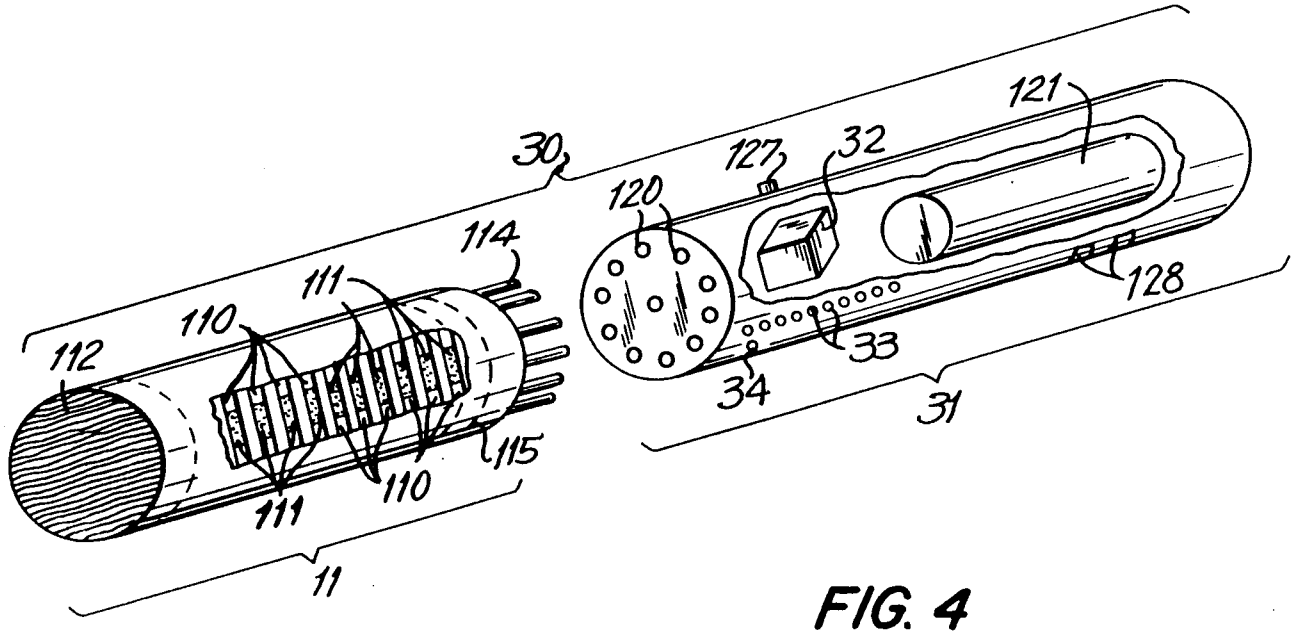
FIG. 4 is an exploded perspective view of the article of FIG. 3.

The linear array of heaters 110 shown in FIGS. 2, 4 and 6 is shown for ease of illustration only, and does not necessarily represent the preferred embodiment of heaters to be used in the present invention. Possible heaters for use in the present invention are described in copending, commonly-assigned U.S. patent application Ser. No. 07/444,569 filed concurrently herewith and hereby incorporated by reference in its entirety. A number of different possible additional heater configurations are shown in FIGS. 7A–7K. The different configurations reflect both mechanical considerations—e.g., ease of manufacture—and materials considerations—e.g., the effect of the heater material on the composition of the flavor-containing substance.

For example, linear heaters 110 shown in FIGS. 2, 4 and 6 could be bars or mesh of stainless steel or other suitable metals or ceramics, although the flavor generating medium would adhere more readily to a mesh.

A preferred material for the heaters is graphite. Graphite heaters, possibly compounded with other forms of carbon to provide the desired electrical resistance and therefore the desired heating, are stable and non-reactive, and can be molded, extruded or machined into many forms and attached, by suitable contacts, to power source 121. For example, a cylindrical graphite structure 70 as shown in FIG. 7A can be formed with a number of inwardly directed vanes 701 equal to the desired number of puffs. The inner surfaces 702 of structure 70 can be coated with the flavor generating medium. By connecting one pole of power source 121 to the outer surface 703 of structure 70, and sequentially connecting the other pole to the inwardmost edge 704 of each vane 701, one can heat each vane 701 to the desired temperature. Inwardmost edge 704 of each vane 701 is increased in thickness as compared to the body of vane 701 for added strength and to provide a conductive pathway to improve the uniformity of electrical flow and heating across the vane to maximize the use of available heater surface area. Covering both surfaces of each vane 701 with flavor generating medium also maximizes the use of available heater area and, thus, heater energy. Concentrating the flavor-generating medium further increases the amount of flavor-containing substance generated or released per unit of expended electrical energy.

Similarly, graphite structure 71 can be provided which functions like structure 70, except that vanes 711 radiate outwardly from a central core 713, as shown in FIG. 7B. The flavor generating medium is deposited on the surfaces 712 between vanes 711. Power can be applied between core 713 and the outer edge 714 of the appropriate vane 711. Outer edge 714 of each vane is increased in thickness as compared to the body of vane 711 for added strength and to provide a conductive pathway as discussed above.

Each of structures 70 and 71 has eight vanes 701, 711, representing eight charges of flavor generating medium which provide eight puffs. The structures shown below would provide ten puffs.

Structure 72 shown in FIG. 7C is a hollow cylinder of graphite, divided by nine opposed pairs of slits 720, 721 into ten opposed pairs of segments 722, 723. The flavor generating medium is coated on the inner or outer surface 724 of cylinder 72. When one pole of power source 121 is connected to each of opposed segments 722, 723, heat is generated predominantly in that pair only, heating the flavor generating medium coated onto that pair. Although all ten pairs are interconnected at midline 725, at most a low current flows along midline 725 outside the pair being heated.

Structure 73 shown in FIG. 7D is a solid or hollow (not shown) cylinder of graphite, with ten grooves 730 formed in its surface, separating eleven lands 731. Grooves 730 are coated with flavor generating medium 732. By applying power source 121 across two adjacent lands 731, one heats structure 73 between those two lands 731 along with flavor generating medium 732 in groove 730 therebetween.

Figure 7E:
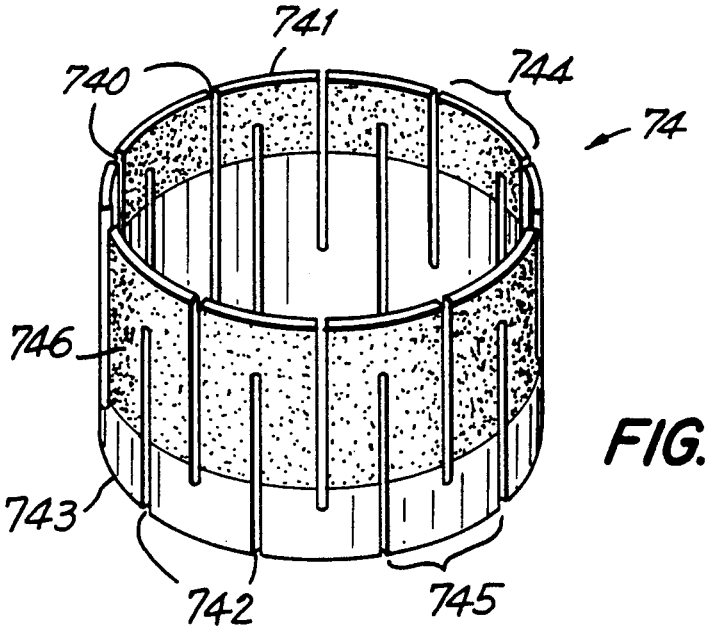

Structure 74 shown in FIG. 7E is a graphite ring divided by two interleaved sets of ten slots each, one set of slots 740 extending from one side 741 of the ring, and the other set of slots 741 extending from the other side 743 of the ring, forming ten U-shaped fingers 744 that are coated inside or outside with flavor generating medium 746 adjacent side 741, and ten uncoated bases 745 adjacent side 743, each base 745 connected to one leg each of two adjacent fingers 744 so that two adjacent bases 745 contact opposite ends of one finger 744. By applying power from source 121 across two adjacent bases 745 heat is generated predominantly in that the finger 744 that they contact in common, heating the flavor generating medium thereon.

Figure 7F:
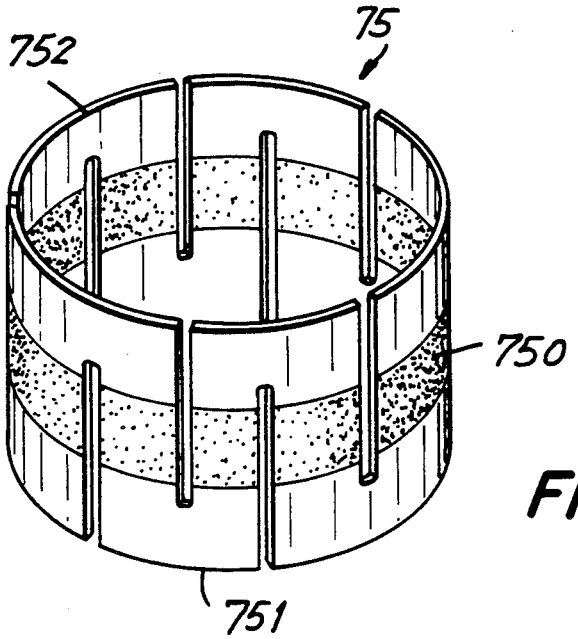

Structure 75 shown in FIG. 7F is similar to structure 74, except that it has only five each of slots 740 and 742, and the flavor generating medium 750 is confined to the band of overlap of slots 740 and 742, thus forming ten separate areas of tobacco-derived material 750, as well as five bases 751 and five fingers 752. Bases 751 and fingers 752 are arranged so that when one pole of power source 121 is applied to one base 751, two areas 750 can be heated sequentially by sequentially applying the other pole of power source 121 to each of two adjacent fingers 752. To heat further areas 750, the second pole of power source 121 is left attached to the second one of fingers 752 and the first (or third) pole of power source 121 is connected to a different base 751, and so on.

Structure 76 shown in FIG. 7G is similar to structure 72 shown in FIG. 7C, except that a slidable heater 760 is provided to serially heat each pair of opposed segments 722, 723 by conduction, convection or radiation as it is moved in the direction of arrow A. Optionally, structure 703 can be indexed through stationary heater collar 760. A variant structure 77 shown in FIG. 7H is an extruded rod 770 (hollow or solid) made solely of flavor generating medium and components to add mechanical strength, provided with slidable heater 771. Heater 771 is similar to heater 760. The heater is moved in the direction of arrow A, either manually by the consumer, or automatically by electromagnetic or mechanical means (not shown) linked to the consumer's actuation of the heater with pushbutton 127 or with a switch activated by either pressure or airflow provided by the consumer during a puff. For example, in addition to closing electrical contacts, pushbutton 127 could also engage a mechanical ratchet (not shown). Alternatively, the closing of switch 127 (or alternative switches) could, in addition to providing current for the heaters, move a pawl which allows a spring attached to collar 760 or 771 to move the collar one position in the direction of arrow A.

Figure 7I:
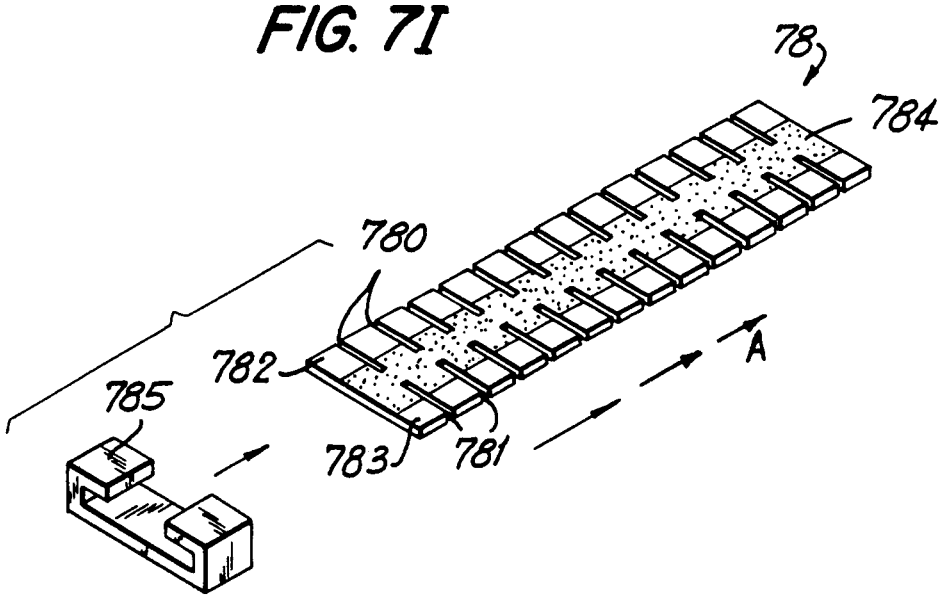
Figure 7J:
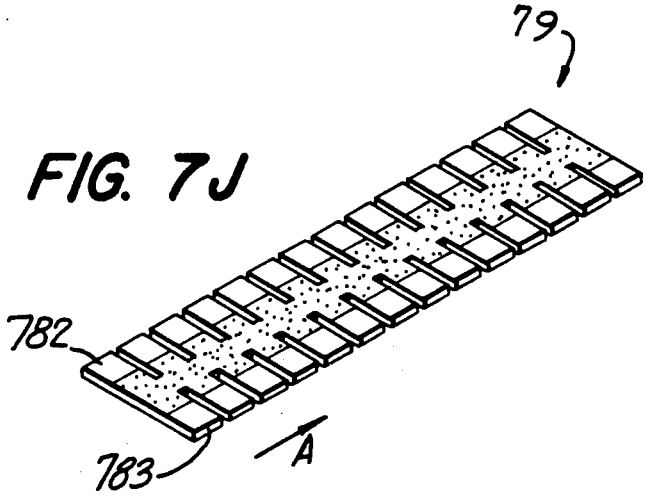
Figure 7K:
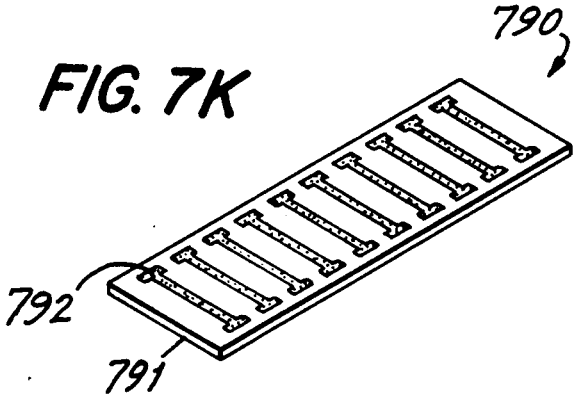

The same principle can be applied to each of the three heater structures shown in FIGS. 7I, 7J and 7K. Structure 78 of FIG. 7I is a thermally conductive substrate divided by slots 780, 781 into strips 782, 783. Applying heat to the width-wise strips defined by opposed pairs of strips 782, 783 causes heat to flow primarily to those width-wise strips, heating that section of substrate 78 and flavor generating medium 784 thereon. Heat is applied to strips 782, 783 by passing substrate 78 through a heater 785. The movement of substrate 78 through heater 785 in the direction of arrow A can be accomplished in any of the ways set forth above for the movement of collars 760, 771. Heater 785 can be disposable, as part of section 11, or permanent, as part of section 12, 31 or 52, with only substrate 78 being replaced as part of section 11.

Structure 79 of FIG. 7J is similar to structure 78, except that substrate 79 is made from graphite, which serves as its own heater, so that heater 785 can be omitted and replaced with electrical contacts (not shown) for applying power across strips 782, 783 of substrate 79.

Structure 790 of FIG. 7K has an inert substrate 791 on which lines 792 of flavor generating medium, mixed with graphite or similar material to make it conductive, are laid. Contacts similar to those used with structure 79 are used to apply power across lines 792, which, by virtue of their conductivity, form their own heaters integral with the flavor generating medium.

Figure 8A:
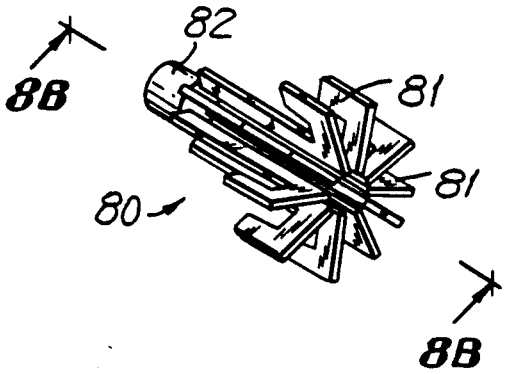
FIGS. 8A–8C are views of a particularly preferred embodiment of heaters for use in the present invention.
Figure 8B:
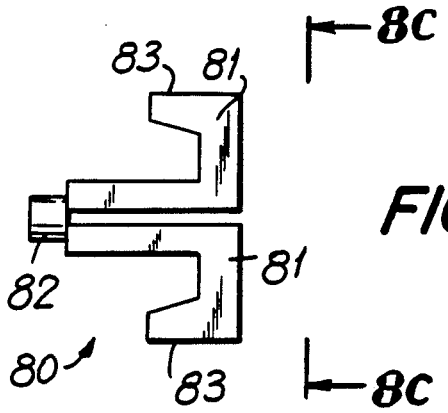
Figure 8C:
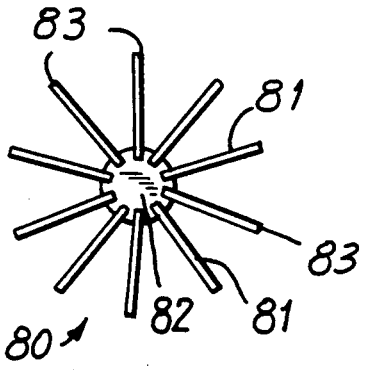

FIGS. 8A–8C show a particularly preferred embodiment of a heater structure 80 for use with the present invention. Structure 80 includes ten U-shaped heater elements 81 connected to a central hub 82. Preferably, heater elements 81 are made of graphite. Hub 82 serves as one contact point for the application of power to each heater element 81, while outer edge 83 of each heater element 81 serves as the second contact point for that respective heater. Hub 82 is connected to one contact and outer edges 83 are connected to a series of ten contacts that are activated sequentially to sequentially heat heater elements 81. (As used herein, "sequentially" does not necessarily imply any spatial order, but only that some individual element is heated after some other individual element.)

Whatever heater design is used, it is subject to several design criteria. First, the electrical resistance of the heater should be matched to the voltage of power source 121 so that the desired rate of heating is accomplished. At the same time the resistance must be large compared to the internal resistance of power source 121 to avoid excessive losses due to the internal resistance. Second, the surface area must be sufficient to allow for support of the flavor generating medium with proper thickness of the flavor generating medium to allow rapid heating and with proper area for generating or release of vapors or aerosols containing flavors or other volatile components. Third, the thermal conductivity, heat capacity and heat mass must be such that the heat generated is conducted effectively to the flavor generating medium but not away from the heater to the surroundings, and such that the excessive energy is not necessary to heat the heater itself.

The contact resistance between the heater material and the contacts should be kept low. If necessary, suitable materials, such as tantalum, can be compounded or coated at the contact points to lower contact resistance. Any materials added should be non-reactive at the operating temperatures.

Heater/flavor/mouthpiece section 11 preferably would contain heater elements as described above coated with flavor generating medium, all wrapped in a tube, which can be made of heavy paper, to allow it to be inserted by a consumer into section 12, 31 or 52.

Power source 121 preferably must be able to deliver sufficient energy to generate or release flavors or other components in vapor or aerosol form from ten charges of flavor generating medium, while still fitting conveniently in the article. However, the energy to be delivered is not the only criterion, because the rate at which that energy is delivered—i.e., the power—is also important. For example, a conventional AAA-sized alkaline cell contains enough energy to heat several hundred charges of flavor generating medium, but it is not designed to deliver the necessary energy at a high enough rate. On the other hand, nickel-cadmium (Ni-Cad) rechargeable batteries are capable of providing much greater power on discharge. A preferred power source is four N50-AAA CADNICA nickel-cadmium cells produced by Sanyo Electric Company, Ltd., of Japan. These batteries provide 1.2-volts each, for a total of 4.8 volts when connected in series. The four batteries together supply about 264 milliwatt-hours, which is sufficient to power at least one ten puff article without recharging. Of course, other power sources, such as rechargeable lithium-manganese dioxide batteries, can be used. Any of these types of batteries can be used in power source 121, but rechargeable batteries are preferred because of cost and disposal considerations associated with disposable batteries. In addition, if disposable batteries are used, section 12, 31 or 52 must be openable for replacement of the battery.

If rechargeable batteries, as preferred, are used, a way must be provided to recharge them. A conventional recharging unit (not shown) deriving power from a standard 120-volt AC wall outlet, or other sources such as an automobile electrical system or a separate portable power supply, can be used. The charge rate and controller circuitry must be tailored to the specific battery system to achieve optimal recharging. The recharging unit would typically have a socket into which the article, or at least section 12, 31 or 52, would be inserted. Contacts 128 on section 12, 31 or 52 connected to power source 121 would contact corresponding contacts in the recharging unit.

The energy content of a battery in power source 121 can be more fully exploited, despite the power or current limitation of the battery, if a capacitor is included in power source 121 as well. The discharge of the capacitor can be used to power heaters 110. Capacitors are capable of discharging more quickly than batteries, and can be charged between puffs, allowing the battery to discharge into the capacitor at a lower rate than if it were used to power heaters 110 directly.

Figure 9:
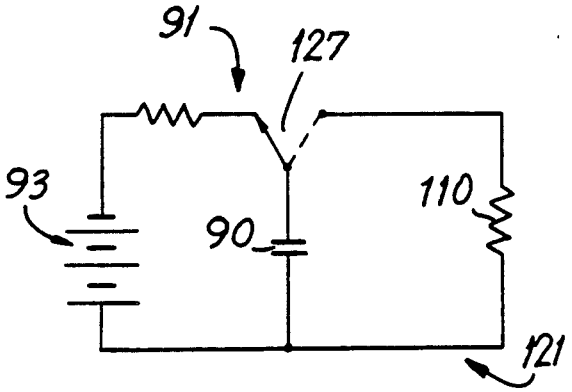
FIG. 9 is a schematic diagram of a preferred power source for use in the present invention.

An idealized schematic form of a power source 121 including a capacitor is shown in FIG. 9. Capacitor 90 is part of a series R-C circuit 91 with resistor 92, in which capacitor 90 is charged between puffs by battery 93 with a time constant RC, where R is the resistance of resistor 92 and C is the capacitance of capacitor 90. (In a real, non-ideal circuit, resistance R would also include the internal resistance of battery 93 and the impedance of capacitor C, as well as the resistance of any wires or other conductors in circuit 91.) In this embodiment, pushbutton (or pressure- or air flow-sensitive device) 127 acts as a single-pole, double-throw momentary switch that normally connects capacitor 90 to R-C circuit 91 for charging. When contact is made by depression of pushbutton 127 (or by activation of the above-mentioned devices), capacitor 90 can be disconnected from charging circuit 91 and connected to discharge across heater resistance 110.

Alternatively, power source 121 could include only capacitor 90, with no battery. In such an embodiment, contacts 128 would have to be touched to an external power source to charge capacitor 90. Capacitor 90 could be sized in such a case to require charging after each puff, or to be capable of being charged for a number of puffs (e.g., the same as the number of charges of flavor generating medium in the article). The external power source could be a specially designed ashtray or other appliance (not shown) having power contacts for mating with contacts 128. The ashtray itself could be battery powered or could contain a power supply that connects to a 120 volt AC wall outlet. Another type of external power source could be a socket provided on an automobile dashboard and connected to the electrical system of the automobile, similar to the cigarette lighter currently provided in automobiles.

In another possible embodiment, energy would be coupled to the article by magnetic or electromagnetic induction, followed by suitable rectification and conditioning prior to charging the capacitor. For example, the specially designed ashtray referred to above could contain a suitable generator for coupling magnetic or electromagnetic energy to the article.

If a capacitor is used in the article, the required capacitance is determined by the voltage available for charging and the maximum amount of energy to be stored. For example, if the voltage available is 6 volts and the amount of energy needed for a single puff is 10 joules, then the required capacitance is 0.56 farads. The capacitance needed would increase proportionally if energy for multiple puffs is to be stored. Preferably, the capacitor also has a very low internal resistance, so that the time constant for discharging into heater 110 is determined exclusively by the heater resistance and the capacitance.

Figure 10:
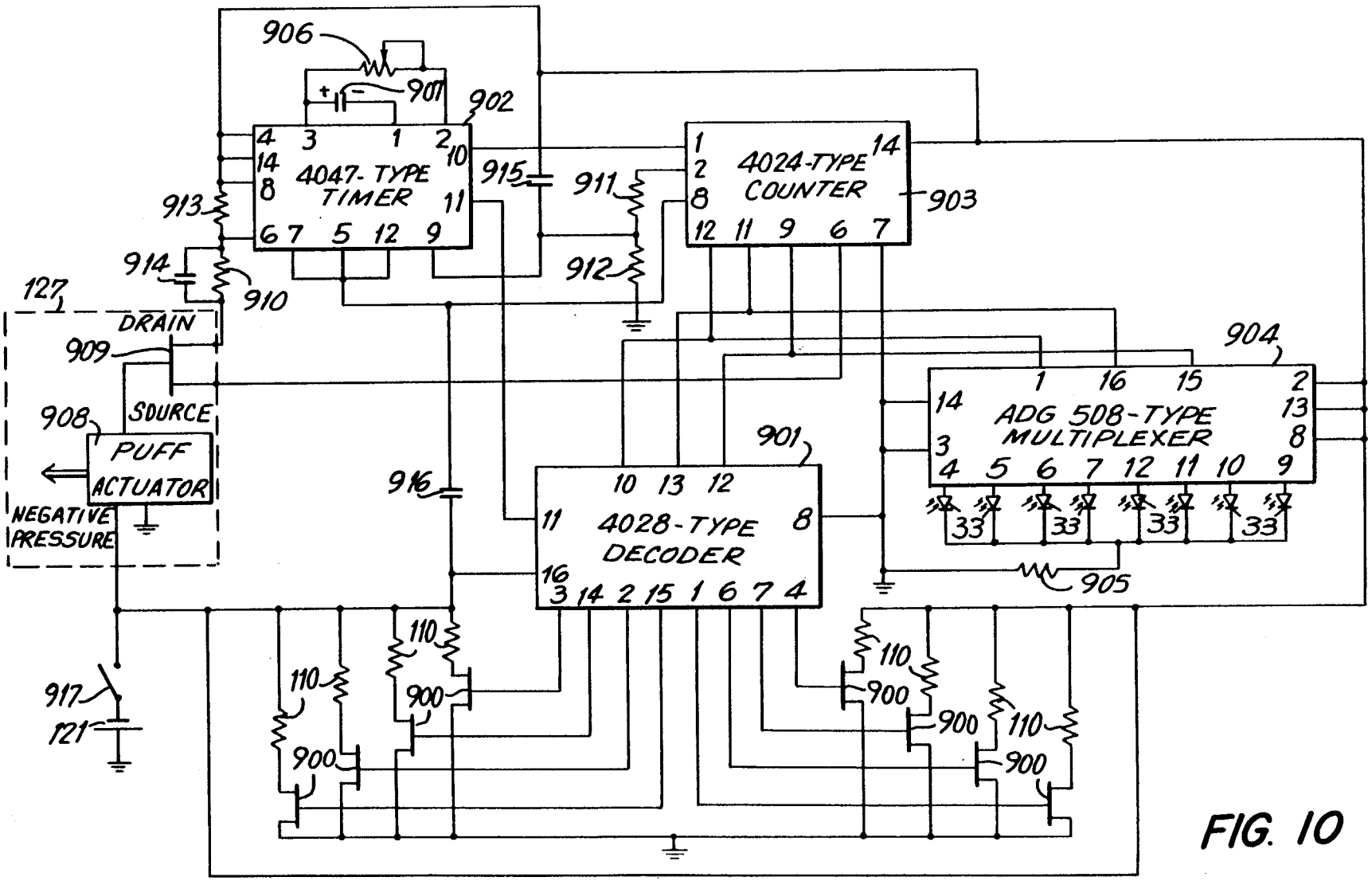
FIG. 10 is a schematic diagram of a preferred embodiment of a control circuit for use in the present invention.

The most preferred embodiment of the present invention includes control circuit 32 of FIG. 10. Control circuit 32 preferably fulfills several functions. It preferably sequences through the ten (or other number of) heaters 110 to select the next available heater 110 each time switch 27 is closed. It preferably applies current to the selected heater for a predetermined duration that is long enough to produce sufficient flavor-containing substance for an average puff, but not so long that the charge of flavor generating medium can begin to burn. It preferably controls indicators 33, 34 which show how much of the article remains or has been used and when one of heaters 110 is active. In addition, it may also lock out switch 127 for a predetermined time period after each actuation to allow time to charge capacitor 90 in power source 121, and to avoid inadvertently energizing the next heater 110.

Control circuit 32 also controls the amount of total particulate matter (TPM) evolved from the flavor generating medium by controlling the temperature to which the flavor generating medium is heated, which is a function of the duration of heating and the power applied. For example, about two milligrams of TPM are typically released when 100 milligrams of the preferred flavor generating medium is heated to 120° C. for 300 seconds, while about twenty-two milligrams of TPM are released when the same amount of flavor generating medium is heated to 280° C. for 300 seconds. Heating five milligrams of flavor generating medium to 300° C. for 2 seconds releases about one milligram of TPM. Thus the total TPM delivery of an article according to this invention can be controlled by selecting the amount of flavor generating medium as well as by tailoring heaters 110 and circuit 32 to control the temperature to which the flavor generating medium is heated and the rate and duration of heating.

A preferred embodiment of control circuit 32 is shown in FIG. 10. In FIG. 10, all points labelled $V_+$ are connected to the positive terminal of power source 121, and all points labelled as ground are connected to the negative terminal of power source 121.

Each heater 110 is connected to $V_+$ directly, and to ground through a respective field-effect transistor (FET) 900. A particular FET 900 will turn on under control of standard 4028-type CMOS BCD-to-decimal decimal decoder 901 (via pins 3, 14, 2, 15, 1, 6, 7, 4). Decoder 901 is also connected (via pin 11) to the complementary output of a 4047-type CMOS timer 902 (also via pin 11). Pin 11 of decoder 901 is high when the output of timer 902 (pin 10) is low. All outputs of decoder 901 remain low if a BCD code greater than or equal to 1001 is applied to its inputs. Therefore an output of decoder 901 can only be on during a positive clock pulse to 4024-type CMOS counter 903. Decoder 901 will decode a standard BCD 4-bit code input from counter 903 into 1-of-10 output. Decoder 901 is connected to supply voltage $V_+$ (at pin 16) and to ground (at pin 8). Decoder 901 receives BCD input from counter 903 (at pins 10, 13, 12).

Heater-active indicators 33 (light-emitting diodes (LEDs) or other indicator devices) are connected to $V_+$ through an ADG508-type multiplexer 904 (via pins 4, 5, 6, 7, 12, 11, 10, 9) supplied by Analog Devices of Norwood, Mass. LEDs 33 are connected to ground via a 2 KΩ current-limiting resistor 905. Multiplexer 904 is connected to $V_+$ (via pins 2, 13, 8) and to ground (via pins 14, 3). Multiplexer 904 receives BCD input from counter 903 (via pins 1, 16, 15). The operation of multiplexer 904 is similar to that of decoder 901 in that it receives BCD input from counter 903, and decodes it such that an individual output is selected through which $V_+$ is supplied, but in this case to LEDs 33 rather than to heaters 110.

Counter 903 is connected to $V_+$ (via pin 14) and to ground (via pins 8, 7), and receives a positive clock pulse from timer 902 (via pin 1). Counter 903 is reset to 0 via a positive pulse (through pin 2). BCD output is provided at pins 12, 11, 9, 6. Every time the clock pulse (receives at pin 1) changes from positive to ground, counter 903 advances one count. Counter 903 counts positive clock pulses and converts the count to BCD. The output at pin 6 is connected to pin 6 of timer 902.

Timer 902 is in a monostable configuration and is connected to $V_+$ (via pins 4, 8, 14) and to ground (via pins 5, 7, 12, 9) for negative triggering (through pin 6). Negative triggering is accomplished by leaving pin 6 positive and then briefly pulling it to ground to initiate the timing sequence. When triggered, the complementary outputs (via pins 10, 11) change for a time period that is dependent upon resistance value R of resistor 906, preferably 2 MΩ (connected between pins 2, 3), and a capacitance value C of capacitor 907, preferably 1 μF (connected between pins 1, 3).

Puff actuator 908 is the source of the negative trigger at pin 6 of timer 902. Puff actuator 908 has two power inputs (For $V_+$ and for ground), and one output. The output drives the gate of MOSFET switch 909. The source of MOSFET switch 909 is connected to counter 903 (at pin 6). The drain of MOSFET switch 909 is connected to timer 902 (at pin 6). Puff actuator 908 can be a device similar to silicon based pressure sensitive sensor Model 163PC01D36 referred to above, or a gas flow transducer such as a wheatstone bridge semiconductor version of a hot wire anemometer.

Resistor 910 preferably has a value of 1 MΩ, while resistors 911, 912, 913 preferably all have values of 10 KΩ. Capacitors 914, 915, 916 preferably all have values of 0.1 μF.

Prior to the consumer taking the initial puff, the control circuitry is turned on via on/off switch 917 or similar device. The heater active indicator LED 33 is illuminated for the first heater 110. Correspondingly, heater number 1 is selected by decoder 901 and awaits firing. Counter 903 is reset to begin counting. Timer 902 complementary output at pin 19 is low (which is the clock to counter 903, pin 1) and at pin 11 is high (which keeps the heater from firing via pin 11 of decoder 901). When the consumer takes a puff, puff actuator 908 causes a trigger of timer 902. The RC time constant is set by resistor 910 and capacitor 913 such that a pulse of desired duration is output from complementary outputs at pins 10, 11 of timer 902. The output from pin 11 of timer 902, connected to pin 11 of decoder 901 goes low, causing the first heater to be heated. The output at pin 10 of timer 902 stays high for the duration set by RC then goes low causing counter 903 to advance one count. The output at pin 11 returns high, discontinuing heater activation. Since the count of counter 903 has advanced by one, the heater active LED illuminated via multiplexer 904 has correspondingly advanced, and the next heater to be fired in sequence has been selected via decoder 901. This cycle will repeat until the final heater has been heated. At such time pin 6 of counter 903 will go high causing timer 902 to become non-triggerable. In such case the heater firing sequence is halted until the circuit is reset by turning it off then on again.

Although not implemented in circuit 32 as depicted in FIG. 10, a lockout function as described above can be provided. An example of a circuit containing such a lockout function is described in co-pending, commonly-assigned U.S. patent application Ser. No. 07/444,818, filed concurrently herewith and hereby incorporated by reference in its entirety.

Thus it is seen that an electrically heated flavor generating article whcih operates at a controlled temperature to produce a consistent release of flavor-containing substance with each puff, which reaches its operating temperature quickly and provides sufficient heat to generate or release the desired flavor-containing substance, without overheating and causing burning of its flavor generating medium, which is self-contained, and which can have the appearance of a conventional cigarette, is provided. One skilled in the art will appreciate that the present invention can be practiced by other than the described embodiments, which are presented for purposes of illustration and not of limitation, and the present invention is limited only by the claims which follow.

What is claimed is:

1. An article for delivering to a consumer an inhalable flavor-containing substance, said article comprising:

a plurality of pre-measured charges of flavor generating medium;

electrical heating means for individually heating each of said pluralilty of charges;

a source of electrical energy for powering said electrical heating means; and p1 control means for selectively applying said electrical energy to said electrical heating means to selectively heat said plurality charges in a predetermined sequence, each of said charges being heated only once and, when heated, delivering a predetermined quantity of flavor-containing substance to said consumer.

2. The article of claim 1 wherein said flavor generating medium comprises tobacco; and when said flavor generating medium is heated, a flavor-containing substance comprising tobacco components is formed.

3. The article of claim 1 wherein said flavor generating medium comprises an aerosol-forming material; and when said flavor generating medium is heated, an aerosol is formed.

4. The article of claim 3 wherein said aerosol-forming material comprises glycerine.

5. The article of claim 4 wherein said aerosol-forming material further comprises water.

6. The article of claim 3 wherein said aerosol-forming material comprises water.

7. The article of claim 1 wherein:

said flavor generating medium comprises tobacco and an aerosol-forming material; and when said flavor generating medium is heated, an aerosol comprising tobacco components is formed.

8. The article of claim 7 wherein said aerosol-forming material comprises glycerine.

9. The article of claim 8 wherein said aerosol-forming material further comprises water.

10. The article of claim 7 wherein said aerosol-forming material comprises water.

11. The article of claim 7 wherein said flavor generating medium is a dried slurry comprising ground tobacco and said aerosol-forming material.

12. The article of claim 1 wherein said flavor generating medium comprises tobacco extracts.

13. The article of claim 1 wherein said flavor generating medium comprises condensed components of smoke produced by combustion of tobacco.

14. The article of claim 1 wherein said electrical heating means comprises resistant heating means in contact with said flavor generating medium.

15. The article of claim 14 wherein:

said resistance heating means is a mesh of resistive wire; and said flavor generating medium is deposited on said wire mesh.

16. The article of claim 15 further comprising an adhesion agent for adhering said flavor-generating medium to said mesh.

17. The article of claim 16 wherein said adhesion agent is a pectin.

18. The article of claim 17 wherein said pectin is a citrus pectin.

19. The article of claim 15 wherein:

said flavor generating medium is a dried slurry comprising ground tobacco and an aerosol-forming material; and said slurry is coated onto said mesh.

20. The article of claim 19 wherein said aerosol-forming material comprises glycerine.

21. The article of claim 20 wherein said aerosol-forming material further comprises water.

22. The article of claim 19 wherein said aerosol-forming material comprises water.

23. The article of claim 1 wherein said flavor-generating medium is concentrated, thereby reducing the amount of electrical energy necessary to form said flavor-containing substance.

24. The article of claim 1 wherein:

said plurality of charges of flavor generating medium are deposited on a substrate; and said electrical heating means is in contact with said substrate.

25. The article of claim 24 further comprising an adhesion agent for adhering said flavor generating medium to said substrate.

26. The article of claim 25 wherein said adhesion agent is a pectin.

27. The article of claim 26 wherein said pectin is a citrus pectin.

28. The article of claim 24 wherein said electrical heating means comprises a plurality of heating elements corresponding to said plurality of charges.

29. The article of claim 24 wherein said electrical heating means comprises:

a heating element; and means for indexing said substrate past said heating element.

30. The article of claim 1 wherein:

said flavor generating medium comprises an electrically conductive material having a selected resistance; whereby:

said electrical heating means is integral with said flavor generating medium.

31. The article of claim 30 wherein said electrical heating means comprises means for conducting electrical energy from said source of electrical energy to said electrically conductive flavor generating medium.

32. The article of claim 31 wherein said electrical heating means comprises a plurality of said conducting means corresponding to said plurality of charges, each of said conducting means contacting one of said charges.

33. The article of claim 30 wherein:

said plurality of charges of flavor generating medium are deposited on a substrate; and said electrical heating means comprises a plurality of conducting means corresponding to said plurality of charges, each of said conducting means contacting one of said charges.

34. The article of claim 30 wherein:

said plurality of charges of flavor-generating medium are deposited on a substrate; and said electrical heating means comprises:

a conducting means for contacting said charges, and means for indexing said substrate past said conducting means, whereby:

said conducting means sequentially contacts each of said charges.

35. The article of claim 1 wherein said electrical heating means comprises graphite.

36. The article of claim 35 further comprising an adhesion agent for adhering said flavor generating medium to said graphite.

37. The article of claim 36 wherein said adhesion agent is a pectin.

38. The article of claim 37 wherein said pectin is a citrus pectin.

39. The article of claim 35 wherein said graphite is compounded with other forms of carbon.

40. The article of claim 35 wherein:

said electrical heating means further comprises electrical contact means for contacting said graphite; and said graphite is coated with a contact-resistance reducing substance.

41. The article of claim 40 wherein said contact-resistance reducing substance comprises tantalum.

42. The article of claim 35 wherein said heating means comprises a cylindrical structure comprising graphite having a plurality of radial vanes, at least one surface of each of said vanes being coated with said flavor generating medium such that each of said vanes has one of said plurality of charges thereon and has a radial edge and an axial edge, all of one of said edges being connected in common to said source of electrical energy, and each of the other of said edges being connected individually to said source of electrical energy.

43. The article of claim 42 wherein said heating means comprises a cylinder comprising graphite, said cylinder having a continuous cylindrical surface and a plurality of said vanes extending inwardly therefrom and extending to an inner edge at a point short of the axis of said cylinder, said outer surface serving as said common connection to said source of electrical energy, and each said inner edge serving as said individual connection to said source of electrical energy.

44. The article of claim 42 wherein said heating means comprises a cylinder comprising graphite, said cylinder having a cylindrical inner core and a plurality of said vanes extending outwardly therefrom and extending to an outer edge at a point remote from the axis of said cylinder, said inner core serving as said common connection to said source of electrical energy, and each said outer edge serving as said individual connection to said source of electrical energy.

45. The article of claim 44 wherein said heating means comprises a hollow cylinder comprising graphite, said cylinder having said flavor generating medium coated thereon, said cylinder being divided by at least one pair of opposed partial circumferential slits into a plurality of opposed circumferential strips, each strip of an opposed pair of strips being connected to a pole of said source of electrical energy forming a ring-like heater segment, the flavor generating medium on said inner side of each of said ring-like segments forming one of said plurality of charges.

46. The article of claim 45 wherein said heating means comprises a cylinder comprising graphite, said cylinder having an outer surface having a plurality of grooves therein separated by lands thereon, each of said grooves being coated with said flavor generating medium and forming one of said individual charges thereof, each of said grooves being heated by applying power from said source of electrical energy to a land on either side of said groove.

47. The article of claim 46 wherein said heating means comprises a ring comprising graphite and having first and second ends, and divided by first and second interleaved sets of slits, each set of slits extending from a respective one of said ends more than halfway to an opposite one of said ends, into a plurality of bases adjacent said first end and fingers adjacent said second end, said fingers being coated with said flavor generating medium, individual charges of said flavor generating medium being heated by one of (a) applying power from said source of electrical energy to one of said bases and one of said fingers, and (b) applying power from said source of electrical energy to adjacent ones of said bases.

48. The article of claim 47 wherein said flavor generating medium is coated onto said ring in a circumferential band in an area overlapped by both said first and second sets of slits, individual charges of said flavor generating medium being heated by applying power from said source of electrical energy to adjacent ones of said bases.

49. The article of claim 47 wherein said flavor generating medium is coated on to said ring in a circumferential band in an area beginning at said second and extending toward said first end a shorter distance than said set of slits extending from said second end, individual charges of said flavor generating medium being heated applying power from said source of electrical energy to one of said bases and one of said fingers.

50. The article of claim 47 wherein said heating means comprises an elongated sheet comprising graphite, said sheet being laterally divided into opposed pairs of strips by opposed pairs of slits extending inwardly from longitudinal edges of said sheet, said flavor generating medium being coated onto said sheet in a longitudinal band spaced from said longitudinal edges, individual charges of said flavor generating medium being heated by applying power from said source of electrical energy to opposed ones of said strips.

51. The article of claim 50 wherein said heating means comprises a plurality of U-shaped vanes, each of said vanes having two legs interconnected at their proximate ends by a base, one of said legs being longer than the other of said legs, said vanes being joined to an electrically conductive hub at distal ends of said longer legs such that said vanes are oriented radially with said longer legs adjacent one another, said bases extending radially outward, and said shorter legs extending parallel to said longer legs but spaced radially outwardly therefrom, said vanes being coated with said flavor generating medium, individual charges of said flavor generating medium being heated by applying power from said source of electrical energy to said hub and to a respective one of said shorter legs.

52. The article of claim 1 wherein said source of electrical energy comprises a battery.

53. The article of claim 52 wherein said battery is disposable.

54. The article of claim 52 wherein said battery is rechargeable.

55. The article of claim 54 wherein said source of electrical energy comprises a capacitor.

56. The article of claim 55 wherein said source of electrical energy further comprises means for charging said capacitor.

57. The article of claim 56 wherein said capacitor charging means comprises a battery.

58. The article of claim 56 wherein said battery is disposable.

59. The article of claim 56 wherein said battery is rechargeable.

60. The article of claim 56 wherein said capacitor charging means comprises contact means for connecting said capacitor to an external voltage source.

61. The article of claim 60 wherein said capacitor has a capacitance sufficient to store energy for heating one of said charges of flavor generating medium.

62. The article of claim 60 wherein said capacitor has a capacitance sufficient to store energy for heating at least some of said plurality of charges of flavor generating medium.

63. The article of claim 62 wherein said capacitance is sufficient to store energy for heating all of said plurality of charges of flavor generating medium.

64. The article of claim 63 wherein said control means comprises:

means for selecting one of said plurality of charges of flavor generating medium; and means for, when a consumer desires to puff said article, applying a pulse of electrical energy to heat said selected one of said plurality of charges of flavor generating medium.

65. The article of claim 64 wherein said selecting means is manual.

66. The article of claim 64 wherein said selecting means is automatic.

67. The article of claim 66 wherein said automatic selecting means selects each of said plurality of charges sequentially.

68. The article of claim 66 wherein said control means further comprises sequential indication means for indicating which of said plurality of charges is selected.

69. The article of claim 64 wherein said pulse applying means applies a pulse of predetermined duration.

70. The article of claim 69 wherein said control means further comprises pulse indication means for indicating when said pulse is being applied.

71. The article of claim 69 wherein said pulse applying means comprises actuation means and applies said pulse in response to actuation of said actuation means by a consumer.

72. The article of claim 71 wherein said control means further comprises lockout means for disabling said actuation means for a predetermined lockout period after an actuation thereof.

73. The article of claim 71 wherein said actuation means comprises a pushbutton.

74. The article of claim 71 wherein said actuation means comprises a switch actuated when a consumer draws on said article.

75. The article of claim 74 wherein said switch is actuated by a pressure-sensitive sensor.

76. The article of claim 74 wherein said switch is actuated by a flow-sensitive sensor.

77. The article of claim 64 wherein said control means further comprises pulse indication means for indicating when said pulse is being applied.

78. The article of claim 1 wherein said control means causes said heating means to heat each charge of said flavor generating medium to a temperature of from about 100° C. to about 600° C.

79. The article of claim 78 wherein said control means causes said heating means to heat each charge of said flavor generating medium to a temperature of from about 200° C. to about 500° C.

80. The article of claim 79 wherein said control means causes said heating means to heat each charge of said flavor generating medium to a temperature of from about 300° C. to about 400° C.

81. The article of claim 1 wherein said control means causes said heating means to heat each charge of said flavor generating medium for a duration of from about 0.1 second to about 4 seconds.

82. The article of claim 81 wherein said control means causes said heating means to heat each charge of said flavor generating medium for a duration of from about 0.5 second to about 1.5 seconds.

83. The article of claim 82 wherein said control means causes said heating means to heat each charge of said flavor generating medium for a duration of from about 0.8 second to about 1.2 seconds.

84. The article of claim 83 wherein said control means further causes said heating means to heat each charge of said flavor generating medium to a temperature of from about 300° C. to about 400° C.

* * * * *